United States Patent [19]

Roberts

[11] 3,961,732

[45] June 8, 1976

[54] POURING ACCESSORY

[76] Inventor: Marshall E. Roberts, 610 East Ave., Opelika, Ala. 36801

[22] Filed: May 12, 1975

[21] Appl. No.: 576,463

[52] U.S. Cl. ..... 272/570
[51] Int. Cl.[2] ..... B65D 5/74
[58] Field of Search ..... 222/570, 569, 568

[56] References Cited

UNITED STATES PATENTS

| | | | |
|---|---|---|---|
| 2,817,465 | 12/1957 | Gray | 222/570 |
| 2,909,306 | 10/1959 | Inotay | 222/570 |
| 3,102,667 | 9/1963 | Ullevig | 222/569 |
| 3,400,867 | 9/1968 | Giannone | 222/570 |

*Primary Examiner*—Allen N. Knowles
*Assistant Examiner*—Norman L. Stack, Jr.
*Attorney, Agent, or Firm*—Daniel Jay Tick

[57] ABSTRACT

A flexible sheet-type member is removably accommodated in the trough of the upper rim of a container. The member guides the liquid poured from the container out of the container bypassing the trough and thereby preventing the liquid from entering the trough and from spilling on the outside of the container.

4 Claims, 5 Drawing Figures

FIG. 1
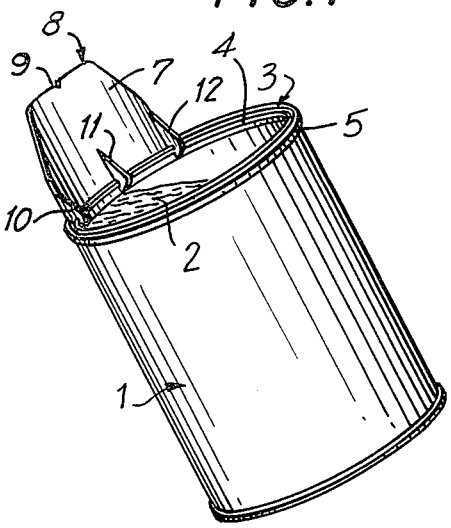
FIG. 2
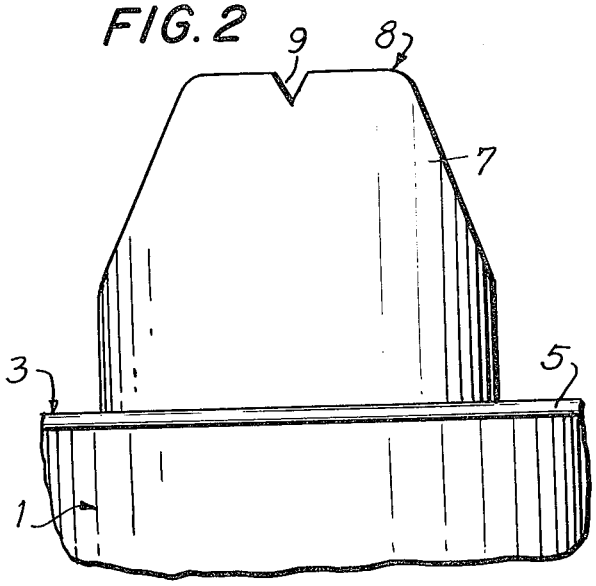
FIG. 3
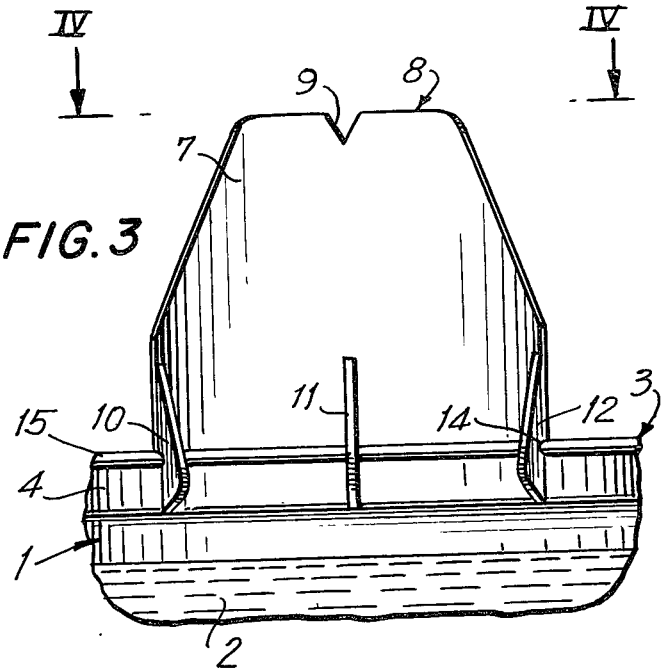
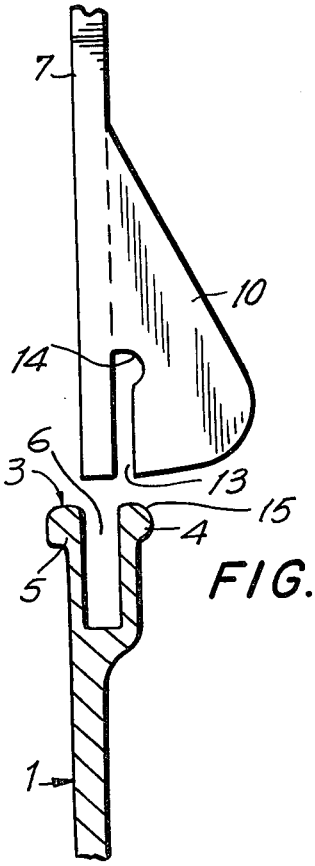
FIG. 5
FIG. 4
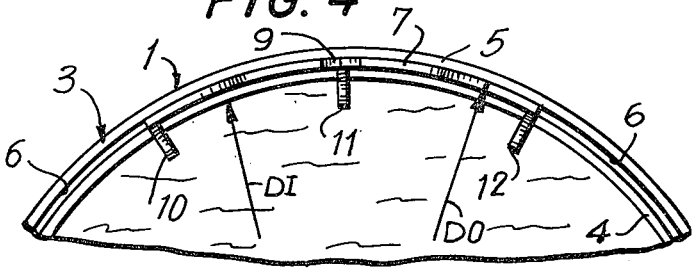

POURING ACCESSORY

BACKGROUND OF THE INVENTION

The present invention relates to a pouring accessory. More particularly, the invention relates to a pouring accessory for a container storing liquid in a substantially airtight manner and having an upper rim and a pair of concentric spaced lips formed in the upper rim to form a trough therebetween.

A container of the aforedescribed type is usually a paint can for storing paint. When such a container is used and paint or other liquid is poured therefrom the paint is difficult to pour as desired, because of the intervening trough and the paint spills due to the difficulty in pouring as desired, and requires cleaning. Furthermore, the paint spills on the outside of the can and covers and obstructs the label and instructions. The paint also spills into the trough and prevents an airtight seal when the cover of the can is replaced after use. This causes hardening and waste of the paint remaining in the can and the loss of other liquids, which must be stored airtight, due to hardening and evaporation, and the like, caused by exposure to air.

The principal object of the invention is to provide a pouring accessory for a container storing liquid in a substantially airtight manner and having an upper rim and a pair of concentric spaced lips formed in the upper rim to form a trough therebetween.

An object of the invention is to provide a pouring accessory for a container storing liquid in a substantially airtight manner and having an upper rim and a pair of concentric spaced lips formed in the upper rim to form a trough therebetween, which accessory is of simple structure, inexpensive in manufacture and mass produced with facility and convenience.

Another object of the invention is to provide a pouring accessory for a container storing liquid in a substantially airtight manner and having an upper rim and a pair of concentric spaced lips formed in the upper rim to form a trough therebetween, which accessory guides liquid from the container bypassing the trench, preventing liquid from entering the trough and preventing liquid from spilling on the outside of the container, thereby permitting substantially airtight resealing of the container after use and preventing the loss of liquid due to hardening, spilling or evaporation.

Still another object of the invention is to provide a pouring accessory for a container storing liquid in a substantially airtight manner and having an upper rim and a pair of concentric spaced lips formed in the upper rim to form a trough therebetween, which accessory guides liquid from the container neatly and directly and overcomes the disadvantages of pouring without the pouring accessory.

BRIEF SUMMARY OF THE INVENTION

The pouring accessory of the invention is for a container storing liquid in a substantially airtight manner and having an upper rim and a pair of concentric spaced lips formed in the upper rim to form a trough therebetween. The lips constitute an inner lip having a predetermined diameter and an outer lip having a diameter greater than the predetermined diameter. In accordance with the invention, the pouring accessory comprises a substantially flexible sheet-type member removably accommodated in the trough of the upper rim of a container for guiding liquid poured from the container out of the container bypassing the trough and thereby preventing the liquid from entering the trough and from spilling on the outside of the container.

The sheet-type member is of substantially trapezoidal configuration and has a plurality of spaced securing devices for releasably securing the member to the inner lip of the upper rim of the container. Each of the securing devices comprises a substantially rib-like member extending substantially perpendicularly from the sheet-type member and having a slot formed therein in a part thereof abutting the sheet-type member for accommodating the inner lip of the upper rim of the container.

The sheet-type member comprises plastic and has an outer edge spaced farthest from the container and a substantially V-shaped notch formed in the outer edge.

The container may be a paint can for storing paint.

BRIEF DESCRIPTION OF THE DRAWINGS

In order that the invention may be readily carried into effect, it will now be described with reference to the accompanying drawing, wherein:

FIG. 1 is a perspective view of an embodiment of the pouring accessory of the invention mounted in the trough of the upper rim of a container storing liquid in a substantially airtight manner and having an upper rim and a pair of concentric spaced lips formed in the upper rim to form a trough therebetween;

FIG. 2 is a view, on an enlarged scale, from the outside, of the embodiment of FIG. 1 of the pouring accessory of the invention mounted in the trough of the upper rim of a container;

FIG. 3 is a view, on an enlarged scale, from the inside, of the embodiment of FIG. 1 of the pouring accessory of the invention mounted in the trough of the upper rim of a container;

FIG. 4 is a top view, taken along the lines IV—IV, of FIG. 3; and

FIG. 5 is a side view, on an enlarged scale and partly in section, of the embodiment of FIG. 1 of the pouring accessory of the invention prior to mounting in the trough of the upper rim of a container.

In the FIGS., the same components are identified by the same reference numerals.

DETAILED DESCRIPTION OF THE INVENTION

The pouring accessory of the invention is for a container 1 (FIGS. 1 to 4) storing liquid 2 such as for example, paint (FIG. 1) in a substantially airtight manner. The container 1 has an upper rim 3 (FIGS. 1 to 3) and a pair of concentric spaced lips 4 and 5 (FIGS. 4 and 5) formed in the upper rim to form a trough 6 therebetween (FIGS. 4 and 5). The lips 4 and 5 constitute an inner lip 4 having a predetermined diameter DI (FIG. 4) and an outer lip 5 having a diameter DO (FIG. 4) greater than the predetermined diameter.

The pouring accessory of the invention comprises a substantially flexible sheet-type member 7 (FIGS. 1 to 5) of any suitable plastic material, paper, or the like, having sufficient rigidity to function as a spout. The member 7 is removably accommodated in the trough 6 of the upper rim 3 of the container 1 for guiding the liquid 2 such as, for example, paint, poured from the container, out of the container. The member 7 causes the liquid 2 to bypass the trough 6 and thereby prevents the liquid from entering said trough and from spilling on the outside of the container 1.

The member 7 thus keeps the trough 6 clean, so that the cover of the container 1 may be reinstalled in a substantially airtight manner to permit the continued storage of the liquid in the container without loss or deterioration after use of some of the liquid. The member 7 also prevents spilling of the liquid on the outside of the container 1, so that it prevents obliteration of the label of contents and/or instructions for use on the outside of said container.

The member 7 is of substantially trapezoidal configuration and tapers toward its outer edge 8 spaced farthest from the container 1 (FIGS. 1 to 3). A substantially V-shaped notch 9 (FIGS. 1 to 3) is formed in the outer edge 8 of the member 7.

Three spaced securing devices 10, 11, and 12 (FIGS. 1, 3 and 4) of the member 7 releasably secure said member to the inner lip 4 of the upper rim 3 of the container 1, as shown in FIGS. 1 to 4. Each of the securing devices 10, 11, and 12 comprises a substantially rib-like member extending substantially perpendicularly from the sheet-type member 7, as shown in FIGS. 1 and 3 to 5. Each of the rib-like members 10, 11 and 12 has a slot formed therein in a part thereof abutting the member 7 for accommodating the inner lip 4 of the upper rim 3 of the container 1. Thus, as shown in FIG. 5, the rib-like member 10 has a slot 13 formed therein in a part therein abutting the member 7. The slot 13 accommodates the inner lip 4 of the rim 3 and has a rounded inner end 14 (FIG. 5) to accommodate the rounded edge 15 (FIG. 5) of said inner lip.

The member 7 is installed by holding it in the area of the outer edge 8 thereof with one hand and inserting the inner edge thereof, closest to the container 1, into the trough 6. The member 7 and the rib-like members 10, 11 and 12 are manually urged inward, toward the container, until the member is seated in the trough 6 and the inner lip 4 of the rim 3 is seated in the slot 13, and so on, of each of the rib-like members. The member 7 is then secured in position for use. It is removed from the container by the reverse process and manual urging in the opposite direction.

While the invention has been described by means of a specific example and in a specific embodiment, I do not wish to be limited thereto, for obvious modifications will occur to those skilled in the art without departing from the spirit and scope of the invention.

I claim:

1. A pouring accessory for a container storing liquid in a substantially airtight manner and having an upper rim and a pair of concentric spaced lips formed in the upper rim to form a trough therebetween, the lips constituting an inner lip having a predetermined diameter and an outer lip having a diameter greater than the predetermined diameter, said pouring accessory comprising a substantially flexible sheet-type member removably accommodated in the trough of the upper rim of a container for guiding liquid poured from the container out of the container bypassing said trough and thereby preventing the liquid from entering said trough and from spilling on the outside of the container; and securing means on the sheet-type member comprising a plurality of spaced securing devices for releasably securing said member to the inner lip of the upper rim of the container, each of the securing devices having a substantially rib-like member extending substantially perpendicularly from the sheet-type member and having a slot formed therein in a part thereof abutting said sheet-type member for accommodating the inner lip of the upper rim of the container.

2. A pouring accessory as claimed in claim 1, wherein the sheet-type member is of substantially trapezoidal configuration.

3. A pouring accessory as claimed in claim 1, wherein the sheet-type member comprises plastic and has an outer edge spaced farthest from the container and a substantially V-shaped notch formed in the outer edge.

4. A pouring accessory as claimed in claim 1, wherein the container is a paint can for storing paint.

* * * * *